US007391290B2

(12) United States Patent
Shen et al.

(10) Patent No.: US 7,391,290 B2
(45) Date of Patent: Jun. 24, 2008

(54) MICRO MAGNETIC LATCHING SWITCHES AND METHODS OF MAKING SAME

(75) Inventors: Jun Shen, Phoenix, AZ (US); Meichun Ruan, Tempe, AZ (US)

(73) Assignee: Schneider Electric Industries SAS, Rueil-Malmaison (FR)

( * ) Notice: Subject to any disclaimer, the term of this patent is extended or adjusted under 35 U.S.C. 154(b) by 217 days.

(21) Appl. No.: 11/218,718

(22) Filed: Sep. 6, 2005

(65) Prior Publication Data

US 2006/0186974 A1 Aug. 24, 2006

Related U.S. Application Data

(63) Continuation of application No. 10/684,588, filed on Oct. 15, 2003, now abandoned.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 4,065,677 | A | 12/1977 | Micheron et al. | |
| 4,461,968 | A | 7/1984 | Kolm et al. | |
| 4,496,211 | A | 1/1985 | Daniel | |
| 4,570,139 | A | 2/1986 | Kroll | |
| 5,016,978 | A | 5/1991 | Fargette et al. | |
| 5,048,912 | A | 9/1991 | Kunikane et al. | |
| 5,398,011 | A | 3/1995 | Kimura et al. | |
| 5,472,539 | A | 12/1995 | Saia et al. | |
| 5,475,353 | A * | 12/1995 | Roshen et al. | 335/78 |
| 5,557,132 | A | 9/1996 | Takahashi | |
| 5,629,918 | A | 5/1997 | Ho et al. | |

(Continued)

FOREIGN PATENT DOCUMENTS

DE 19820821 C1 12/1999

(Continued)

OTHER PUBLICATIONS

Richard P. Feymann, "There's Plenty of Room at the Bottom", Dec. 29, 1959, pp. 1-12, Internet Source: http://222.zyvex.com/nanotech/feynman.html.

(Continued)

*Primary Examiner*—Elvin Enad
*Assistant Examiner*—Bernard Rojas
(74) *Attorney, Agent, or Firm*—Sterne, Kessler, Goldstein & Fox, PLLC.

(57) ABSTRACT

A latching micro magnetic switch includes a magnet located proximate to a supporting structure. The magnet produces a first magnetic field with field lines symmetrically spaced about a central axis or non-uniform field lines. The switch also includes a cantilever supported by the supporting structure. The cantilever has a magnetic material and a longitudinal axis. The magnetic material makes the cantilever sensitive to the first magnetic field, such that the cantilever is configured to move between first and second states. The switch further includes a conductor located proximate to the supporting structure and the cantilever. The conductor is configured to conduct a current. The current produces a second magnetic field, which causes the cantilever to switch between the first and second states.

9 Claims, 2 Drawing Sheets

U.S. PATENT DOCUMENTS

Figure 1:
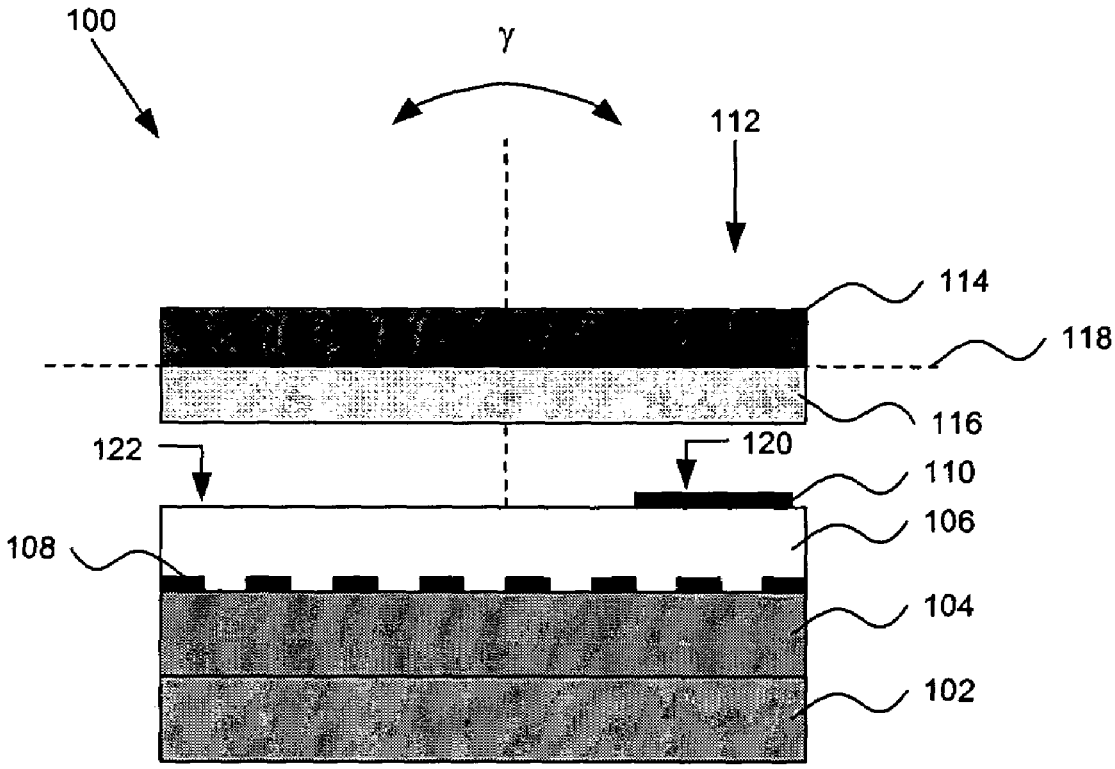

| | | | | |
|---|---|---|---|---|
| 5,696,619 | A | 12/1997 | Knipe et al. | |
| 5,784,190 | A | 7/1998 | Worley | |
| 5,818,316 | A | 10/1998 | Shen et al. | |
| 5,838,847 | A | 11/1998 | Pan et al. | |
| 5,847,631 | A | 12/1998 | Taylor et al. | |
| 5,898,515 | A | 4/1999 | Furlani et al. | |
| 5,945,898 | A | 8/1999 | Judy et al. | |
| 5,982,554 | A | 11/1999 | Goldstein et al. | |
| 6,016,092 | A * | 1/2000 | Qiu et al. | 333/262 |
| 6,016,095 | A | 1/2000 | Herbert | |
| 6,028,689 | A | 2/2000 | Michalicek et al. | |
| 6,078,016 | A | 6/2000 | Yoshikawa et al. | |
| 6,084,281 | A | 7/2000 | Fullin et al. | |
| 6,094,116 | A | 7/2000 | Tai et al. | |
| 6,094,293 | A | 7/2000 | Yokoyama et al. | |
| 6,115,231 | A | 9/2000 | Shirakawa | |
| 6,124,650 | A | 9/2000 | Bishop et al. | |
| 6,143,997 | A | 11/2000 | Feng et al. | |
| 6,160,230 | A | 12/2000 | McMillan et al. | |
| 6,469,602 | B2 | 10/2002 | Ruan et al. | |
| 6,469,603 | B1 | 10/2002 | Ruan et al. | |
| 6,496,612 | B1 | 12/2002 | Ruan et al. | |
| 6,593,834 | B2 * | 7/2003 | Qiu et al. | 333/262 |
| 6,750,745 | B1 * | 6/2004 | Wei et al. | 335/78 |
| 2005/0083157 | A1 | 4/2005 | Shen et al. | |

FOREIGN PATENT DOCUMENTS

| | | | |
|---|---|---|---|
| DE | 10031569 | A1 | 2/2001 |
| EP | 0452012 | A2 | 10/1991 |
| EP | 0452012 | A3 | 10/1991 |
| EP | 0685864 | A1 | 12/1995 |
| EP | 0709911 | A2 | 5/1996 |
| EP | 0709911 | A3 | 5/1996 |
| EP | 0780858 | A1 | 6/1997 |
| EP | 0887879 | A1 | 6/1998 |
| EP | 0869519 | A1 | 10/1998 |
| EP | 887879 | A1 | 12/1998 |
| FR | 2572546 | A1 | 5/1986 |
| JP | 54-161952 | | 12/1979 |
| JP | 4-275519 | | 10/1992 |
| JP | 6-251684 | | 9/1994 |
| WO | WO 97/39468 | | 10/1997 |
| WO | WO 98/34269 | | 8/1998 |
| WO | WO 9927548 | | 6/1999 |

OTHER PUBLICATIONS

E. Fullin, J. Gobet, H.A.C. Tilmans, and J. Bergvist, "A New Basic Technology for Magnetic Micro-Actuators", pp. 143-147.

Jack W. Judy and Richard S. Muller "Magnetically Actuated, Addressable Microstructures", Sep. 1997, Journal of Microelectromechanical Systems, vol. 6, No. 3, Sep. 1997, pp. 249-255.

Ezekiel JJ Kruglick and Kristofer SJ Pister, "Project Overview: Micro-Relays", Tech. Digital Solid-State Sensor and Actuator Workshop, 1998, Hilton Head 98 and 19th International Conference on Electric Contact Phenomena, Nuremberg, Germany, Sep. 1998 (Downloaded from Internet Source: http://www-bsac.eecs.berkeley.edu/Kruglick/relays/relays.html, on Jul. 12, 1999) 2 pgs.

Ezekiel J.J. Kruglick and Kristofer S.J. Pister, "Bistable MEMS Relays and Contact Characterization", Tech. Digital Solid-State Sensor and Actuator Workshop, Hilton Head, 1988 and 19th International Conference on Electric Contact Phenomena, Nuremberg, Germany, Sep. 1998, 5 pgs.

Laure K. Lagorce and Oliver Brand, "Magnetic Microactuators Based on Polymer Magnets", Mar. 1999, IEEE Journal of Microelectromechanical Systems, IEEE, vol. 8., No. 1., Mar. 1999, 8 pages.

"P10D Electricity & Magnetism Lecture 14", Internet Source: http://scitec.uwhichill.edu.bb/cmp/online/P10D/Lecture14/lect14.htn, Jan. 3, 2000, pp. 1-5.

"Ultraminiature Magnetic Latching to 5-relays SPDT DC to C Band", Series RF 341, product information from Teledyne Relays, 1998.

M. Ruan et al., "Latching Microelectromagnetic Relays", Sensors and Actuators A 91 (Jul. 15, 2001), Copyright 2001 Elsevier Science B.V., pp. 346-350.

Xi-Qing Sun, K.R. Farmer, W.N. Carr, "A Bistable Microrelay Based on Two-Segment Multimorph Cantilever Actuators", 11th Annual Workshop on Micro Electrical Mechanical Systems, Heidelberg, Germany, IEEE, Jan. 25-29, 1998, pp. 154-159.

William P. Taylor and Mark G. Allen, "Integrated Magnetic Microrelays: Normally Open, Normally Closed, and Multi-Pole Devices", 1997 International Conference on Solid State Sensors and Actuators, IEEE, Jun. 16-19, 1997, pp. 1149-1152.

William P. Taylor, Oliver Brand, and Mark G. Allen. "Fully Integrated Magnetically Actuated Micromachined Relays", Journal of Microelectromechanical Systems, IEEE, vol. 7, No. 2, Jun. 1998, pp. 181-191.

Tilmans, et al., "A Fully-Packaged Electromagnetic Microrelay", Proc. MEMS '99, Orlando, FL, Jan. 17-21, 1999, copyright IEEE 1999, pp. 25-30.

William Trimmer, "The Scaling of Micromechanical Devices", Internet Source: http://home.earthlink.net/-trimmerw/mems/scale.html on Jan. 3, 2000 (adapted from article Microrobots and Micromechanical Systems by W.S.N. Trimmer, Sensors and Actuators, vol. 19, No. 3, Sep. 1989, pp. 267-287, and other sources).

John A. Wright and Yu-Chong Tai, "Micro-Miniature Electromagnetic Switches Fabricated Using MEMS Technology", Proceedings: 46th Annual International Relay Conference: NARM '98, Apr. 1998, pp. 13-1 to 13-4.

John A. Wright, Yu-Chong Tai and Gerald Lilienthal, "A Magnetostatic MEMS Switch for DC Brushless Motor Commutation", Proceedings Solid State Sensor and Actuator Workshop, Hilton Head, 1998, Jun. 1998, pp. 304-307.

John A. Wright, Yu-Chong Tai, and Shih-Chia Chang, "A Large-Force, Fully-Integrated MEMS Magnetic Actuator", Transducers '97, 1997 International Conference on Solid State Sensors and Actuators, Chicago, Jun. 16-19, 1997.

Ann, Chong H. & Allen, Mark G., A Fully Integrated Micromagnetic Actuator With A Multilevel Meander Magnetic Core, 1992 IEEE, Solid-State Sensor and Actuator Workshop, Technical Digest, Hilton Head Island, South Carolina, Jun. 22-25, 1992, Technical Digest, pp. 14-17.

English-Language Abstract of DE 10031569, published Feb. 1, 2001, 1 page.

English-Language Abstract of DE 19820821, published Dec. 16, 1999, 1 page.

English-Language Abstract of EP 0780858, published Jun. 25, 1997, 1 page.

English-Language Abstract of EP 0869519, published Oct. 7, 1998, 1 page.

English-Language Abstract of FR 2572546, published May 2, 1986, 1 page.

English-Language Abstract of JP 4275519, published Oct. 1, 1992, 1 page.

* cited by examiner

MICRO MAGNETIC LATCHING SWITCHES AND METHODS OF MAKING SAME

CROSS REFERENCE TO RELATED APPLICATIONS

This application is a continuation of U.S. application Ser. No. 10/684,588, filed Oct. 15, 2003, which is incorporated by reference herein in its entirety.

BACKGROUND OF THE INVENTION

1. Field of the Invention

The present invention relates to latching electronic switches. More specifically, the present invention relates to a latching micro magnetic switch.

2. Background Art

Switches are typically electrically controlled two-state devices that open and close contacts to effect operation of devices in an electrical or optical circuit. Relays, for example, typically function as switches that activate or de-activate portions of electrical, optical, or other devices. Relays are commonly used in many applications including telecommunications, radio frequency (RF) communications, portable electronics, consumer and industrial electronics, aerospace, and other systems. More recently, optical switches implemented with relays (also referred to as "optical relays" or simply "relays" herein) have been used to switch optical signals (such as those in optical communication systems) from one path to another.

Although the earliest relays were mechanical or solid-state devices, recent developments in micro-electro-mechanical systems (MEMS) technologies and microelectronics manufacturing have made micro-electrostatic and micro-magnetic relays possible. Such micro-magnetic relays typically include an electromagnet that, when energized, causes a lever to make or break an electrical contact. When the magnet is de-energized, a spring or other mechanical force typically restores the lever to a quiescent position. Such relays typically exhibit a number of marked disadvantages, such as they are bulky in size, heavy, slow, expensive, and difficult to manufacture and integrate. Also, the spring required by conventional micro-magnetic relays may degrade or break over time.

Another micro-magnetic relay includes a permanent magnet and an electromagnet for generating a magnetic field that intermittently opposes the field generated by the permanent magnet. One drawback is that the relay must consume power from the electromagnet to maintain at least one of the output states. Moreover, the power required to generate the opposing field is significant, thus making the relay less desirable for use in space, portable electronics, and other applications that demand low power consumption.

Therefore, what is needed is a latching micro magnetic switch that can consume low power, be small, fast, and easy to integrate. The switch can also be reliable, simple in design, low-cost, and easy to manufacture, and can be useful in optical and/or electrical environments.

BRIEF SUMMARY OF THE INVENTION

Latching micro-magnetic switches of the present invention can be used in a plethora of products including household and industrial appliances, consumer electronics, military hardware, medical devices, and vehicles of all types, just to name a few broad categories of goods. The latching micro-magnetic switches of the present invention have the advantages of compactness, simplicity of fabrication, and have good performance at high frequencies.

An embodiment of the present invention provides a latching micro magnetic switch including a reference plane and a magnet located proximate to a supporting structure. The magnet produces a first magnetic field with non-uniformly spaced field lines approximately orthogonal to the reference plane. The switch also includes a cantilever supported by the support structure. The cantilever has an axis of rotation lying in the reference plane and has magnetic material that makes the cantilever sensitive to the first magnetic field. The cantilever is configured to rotate about the axis of rotation between first and second states. The switch further includes a conductor located proximate to the supporting structure and the cantilever. The conductor is configured to conduct a current. The current produces a second magnetic field having a component approximately parallel to the reference plane and approximately perpendicular to the rotational axis of the cantilever, which causes the cantilever to switch between the first and second states.

Another embodiment of the present invention provides a latching micro magnetic switch including a magnet located proximate to a supporting structure. The magnet produces a first magnetic field with field lines symmetrically spaced about a central axis. The switch also includes a cantilever supported by the supporting structure. The cantilever has a magnetic material and a longitudinal axis. The magnetic material makes the cantilever sensitive to the first magnetic field, such that the cantilever is configured to move between first and second states. The switch further includes a conductor located proximate to the supporting structure and the cantilever. The conductor is configured to conduct a current. The current produces a second magnetic field, which causes the cantilever to switch between the first and second states.

A further embodiment of the present invention provides a latching micro magnetic switch including a magnet located proximate to a supporting structure. The magnet produces a first magnetic field with non-uniformly spaced field lines. The switch also includes a cantilever supported by the supporting structure. The cantilever has a magnetic material and a longitudinal axis approximately perpendicular to the uniformly spaced field lines. The magnetic material makes the cantilever sensitive to the first magnetic field, such that the cantilever can move between first and second states. The switch further includes a conductor located proximate to the supporting structure and the cantilever. The conductor is configured to conduct a current. The current produces a second magnetic field having a component parallel to the longitudinal axis of the cantilever, which causes the cantilever to switch between the first and second states.

Further embodiments, features, and advantages of the present inventions, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

FIG. 1 shows a cross-sectional view of a micro magnetic switch according to an embodiment of the present invention.

Figure 2:
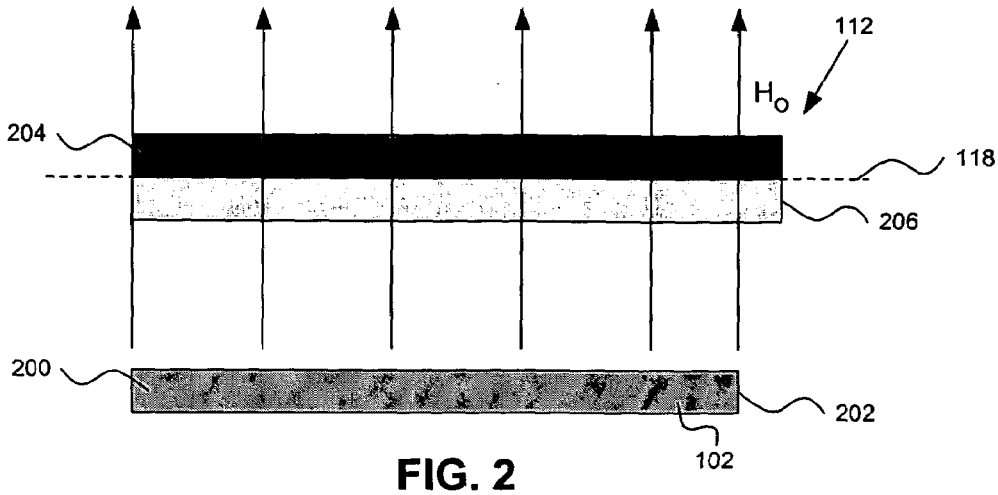
Figure 3:
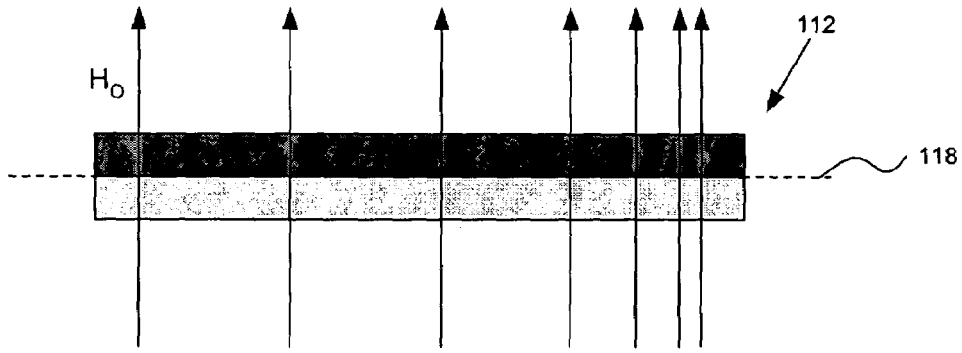
Figure 4:
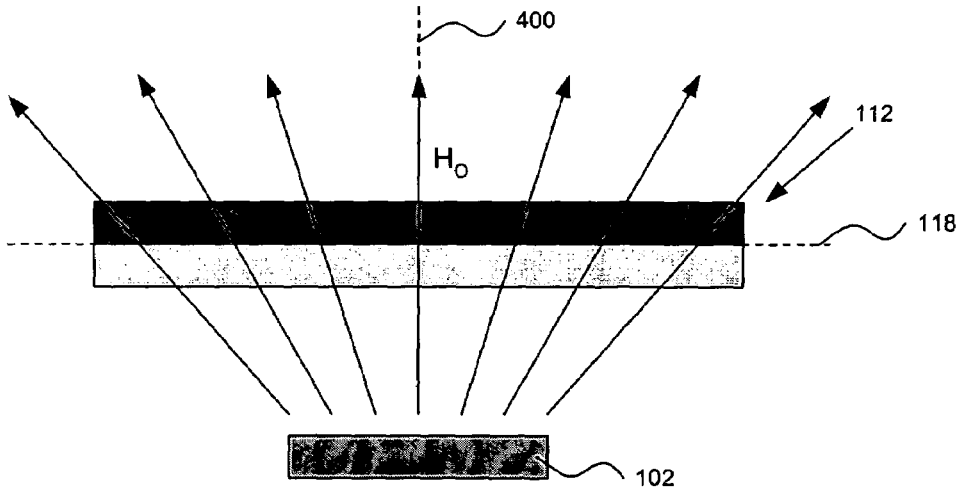

FIGS. 2, 3, and 4 show example magnetic fields for a micro magnetic switch according to embodiments of the present invention.

The present invention will now be described with reference to the accompanying drawings. In the drawings, like reference numbers may indicate identical or functionally similar elements. Additionally, the left-most digit(s) of a reference number may identify the drawing in which the reference number first appears.

DETAILED DESCRIPTION OF THE INVENTION

It should be appreciated that the particular implementations shown and described herein are examples of the invention, and are not intended to otherwise limit the scope of the present invention in any way. Indeed, for the sake of brevity, conventional electronics, manufacturing, MEMS technologies, and other functional aspects of the systems (and components of the individual operating components of the systems) may not be described in detail herein. Furthermore, for purposes of brevity, the invention is frequently described herein as pertaining to micro-machined switches for use in electrical or electronic systems. It should be appreciated that many other manufacturing techniques could be used to create the switches described herein, and that the techniques described herein could be used in mechanical switches, optical switches, or any other switching device. Further, the techniques would be suitable for application in electrical systems, optical systems, consumer electronics, industrial electronics, wireless systems, space applications, or any other application. Moreover, it should be understood that the spatial descriptions (e.g., "above", "below", "up", "down", etc.) made herein are for purposes of illustration only, and that practical latching switches may be spatially arranged in any orientation or manner. Arrays of these switches can also be formed by connecting them in appropriate ways and with appropriate devices and/or through integration with other devices, such as transistors.

The discussion below is directed to one type of switch, which can be called a bi-stable and/or latching switch. This is because the switch is stable in either of two states it is switched to. These above terms are used interchangeably throughout.

Bi-Stable, Latching Switches

FIG. 1 illustrates a cross-sectional view of a switch 100 according to embodiments of the present invention. Switch 100 includes a permanent magnet 102, a substrate 104, a dielectric layer 106, a first conductor (e.g., coil) 108, a second conductor (e.g., contact) 110, and a cantilever 112. Cantilever 112 can include at least a magnetic layer 114 and a conducting layer 116 and can be coupled to substrate 104 or any other structure that allows cantilever 112 to rotate, hinge, or otherwise move between states. Permanent magnet 102 can provide a uniform, constant magnetic field in a region where cantilever 112 is located. Various magnetic field lines are shown in FIGS. 2-4, although magnetic field lines are preferably perpendicular to a longitudinal axis 118 of cantilever 112. Based on the magnetic filed lines in FIGS. 2-4, switch 100 can be considered a bi-stable and/or latching micro-magnetic switch.

An example of a micro-magnetic switch is further described in U.S. Pat. No. 6,469,602 ("the 602 patent") that issued Oct. 22, 2002, entitled "Electronically Switching Latching Micro-magnetic Relay And Method of Operating Same," and U.S. Pat. No. 6,496,612 ("the 612 patent") that issued Dec. 17, 2002, entitled "Electronically Micro-magnetic latching switches and Method of Operating Same," both to Ruan et al., are both incorporated by reference herein in their entireties. Moreover, the details of the switches disclosed in the '602 and the '612 patents can be applicable to implement the switch embodiments of the present invention, as described below.

Exemplary Magnetic Fields

FIG. 2 illustrates a magnetic field (e.g., $H_0$) according to an embodiment of the present invention. The magnetic field is uniformly perpendicular to longitudinal axis 118 of cantilever 112. This is considered an ideal field, and is usually caused by permanent magnet 102 being substantially or approximately parallel to longitudinal axis 118 and when ends 200, 202 of permanent magnet 102 are aligned with ends 204, 206 of cantilever 112. This magnetic field allows switch 100 to be a bi-stable latching switch. This can mean that the switch is stable in first and second states. For example, a first state can be when cantilever 112 interacts with a first area 120 (FIG. 1) of dielectric layer 106 that includes contact 110 and a second state can be when cantilever 112 interacts with a second area 122 (FIG. 1) of dielectric layer 106, which is opposite first area 120, or vice versa.

In operation, an induced magnetic moment in cantilever 112 can point to the left when a torque ($\tau = m \times B$) is clockwise placing cantilever 112 in the first state. The cantilever 112 will stay in the first state unless external influence is introduced. This external influence can be when current is conducted in a first direction through first conductor 108, which causes a second magnetic field. The second magnetic field induces a second moment, which causes the torque to become counter-clockwise. Thus, to move switch 100 to the second state, the current flowing in the first direction through first conductor 108 produces the second magnetic field. The second magnetic field can point dominantly to the right at cantilever 112, re-magnetizing cantilever 112, such that its magnetic moment points to the right. The torque between the right-pointing moment and $H_0$ produces the counter-clockwise torque, forcing cantilever 112 to rotate to the second state. When the current through first conductor 108 stops, the second magnetic field not longer exists. After this occurs, cantilever 112 stays in the second state until current is conducted in a second direction through first conductor 108, which causes cantilever 112 to move from second state to first state based on the same operations described above in reverse. The second state can be based on a temporary current for a short duration.

FIG. 3 illustrates a magnetic field (e.g., $H_0$) according to an embodiment of the present invention. The field lines of the magnetic field are non-uniform relative to spacing between the lines, but the lines are perpendicular to longitudinal axis 118 of cantilever 112. The magnetic field lines are closest together on the right side, which indicates the strongest area of the magnetic field is on the right side. The magnetic field in FIG. 3 can result in the same operations for switch 100 as described above for FIG. 2.

FIG. 4 illustrates a magnetic field (e.g., $H_0$) according to an embodiment of the present invention. The magnetic field is symmetrical about a central axis 400 of cantilever 112, but not completely perpendicular to longitudinal axis 118 of cantilever 112. This magnetic field can be caused by a non-ideal placement of permanent magnet 102 or a relatively small magnet placed along a central point of longitudinal axis 118 of cantilever 112. This can also be caused by a size of permanent magnet 102 or another magnet. The magnetic field in FIG. 4 can result in the same operations for switch 100 as described above for FIG. 2.

Existing systems can easily be modified to replace existing switches having the undesirable characteristics discussed above with the switches according to embodiments of the present invention. Thus, existing products can benefit from advantages provided by using the latching switches manufactured according to embodiments of present invention. Some of those advantages of the switches are their compactness, simplicity of fabrication and design, good performance at high frequencies, reliability, and low-cost.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A latching micro magnetic switch, the switch comprising:

a magnet, located proximate to a supporting structure;

a cantilever, supported by the supporting structure, having a magnetic material, a central axis, and a longitudinal axis, the longitudinal axis crossing the central axis, the magnetic material making the cantilever sensitive to the first magnetic field, such that the cantilever is configured to move between first and second states, wherein the magnet produces a first magnetic field with field lines symmetrically spaced about the central axis of the cantilever; and a conductor, located proximate to the supporting structure and the cantilever, configured to conduct a current, wherein the current produces a second magnetic field that causes the cantilever to switch between the first and second states.

2. The switch of claim 1, wherein once switched to a one of the first and second states, the cantilever is latched in the one of the first and second states by the first magnetic field until further switching occurs.

3. The switch of claim 1, wherein the conductor and the cantilever are formed on the supporting structure.

4. The switch of claim 1, wherein the cantilever is provided between the substrate and the magnet.

5. The switch of claim 1, wherein a magnitude of the second magnetic field is smaller than a magnitude of the first magnetic field.

6. The switch of claim 1, wherein the supporting structure is positioned between the cantilever and the magnet.

7. The switch of claim 1, wherein the supporting structure is a substrate.

8. The switch of claim 1, further comprising:

a reference plane, wherein the symmetrically spaced field lines are at varying angles with respect to the reference plane.

9. The switch of claim 1, wherein the central axis runs through a substantially central portion of a surface of the cantilever.

* * * * *